US005478182A

United States Patent [19]

Hildebrand et al.

[11] Patent Number: 5,478,182

[45] Date of Patent: Dec. 26, 1995

[54] AUTOMATIC PARKING GARAGE

[75] Inventors: Fritz Hildebrand, Berlingen; Ulrich Wernli, Spreitenbach, both of Switzerland

[73] Assignee: Schenk Interservice AG, Winterthur, Switzerland

[21] Appl. No.: 67,787

[22] Filed: May 27, 1993

[30] Foreign Application Priority Data

May 29, 1992 [CH] Switzerland ..... 01735/92
Nov. 11, 1992 [CH] Switzerland ..... 03483/92

[51] Int. Cl.[6] ..... E04H 6/28

[52] U.S. Cl. ..... 414/261; 414/263; 414/257

[58] Field of Search ..... 414/261, 263, 414/228, 231, 252, 253, 257, 259

[56] References Cited

U.S. PATENT DOCUMENTS

| | | | |
|---|---|---|---|
| 3,497,087 | 2/1970 | Vita | 414/252 |
| 4,023,687 | 5/1977 | Salloum | 414/263 X |
| 4,264,257 | 4/1981 | Saurwein | 414/253 X |
| 4,640,214 | 2/1987 | Bruns | 414/263 X |
| 4,976,580 | 12/1990 | Knakrick | 414/263 X |
| 5,024,571 | 6/1991 | Shahar et al. | 414/263 X |
| 5,173,027 | 12/1992 | Trevisani | 414/257 |

FOREIGN PATENT DOCUMENTS

| | | |
|---|---|---|
| 0306058 | 3/1989 | European Pat. Off. . |
| 0395601 | 10/1990 | European Pat. Off. . |
| 848248 | 9/1952 | Germany . |
| 3810116 | 10/1989 | Germany . |
| 3831463 | 3/1990 | Germany . |
| 649340 | 5/1985 | Switzerland . |
| WO91/18162 | 11/1991 | WIPO . |

*Primary Examiner*—Michael S. Huppert
*Assistant Examiner*—Stephen Gordon
*Attorney, Agent, or Firm*—Oblon, Spivak, McClelland, Maier, & Neustadt

[57] ABSTRACT

In an automatic parking garage with a storage silo having a circular periphery, the storage silo having a cylindrical inner shaft and including a plurality of radially positioned parking compartments opening toward the inner shaft on a plurality of stacked parking levels and with a conveying apparatus located in the inner shaft for the transportation of vehicles between at least one entrance and the parking compartments and between the parking compartments and at least one exit, the conveying apparatus including a plurality of vehicle-receiving transport surfaces which are moveable in the vertical direction and are rotatable together in a horizontal direction about a central axis, such that the transport surfaces can be positioned by vertical movement at the level of one of the parking floors, or the at least one entrance, or the at least one exit, and then, by rotation about the central axis, adjacent one of the parking compartments in the corresponding parking level: the transport surfaces as well as the parking compartments and the at least one entrance and exit are positioned radially with respect to the central axis in order to attain a saving of space, simple construction, safe running, and above all a fast vehicle turnover.

3 Claims, 6 Drawing Sheets

AUTOMATIC PARKING GARAGE

BACKGROUND OF THE INVENTION

1. Field of the Invention

The present invention relates to the field of parking garage construction and more particularly, automatic parking garages.

2. Discussion of the Background

Increasing vehicle traffic in the inner cities of the larger centers, as well as the increasing need for space, have made it necessary to provide parking places for ever more vehicles while at the same time minimizing the space used. In this connection above-ground and underground garages are already known, in which vehicles can be positioned close to one another on a plurality of parking levels. In this kind of parking garage, it is usual for the vehicles to move under their own power along appropriate ramps and corridors to the individual parking locations.

This kind of parking is however subject to various disadvantages. For one thing, the entry and exit passages require a substantial amount of additional space, so that with the same construction volume fewer parking spaces can be provided. For another, the exhaust gases make it necessary to provide extensive ventilation installations which greatly increase the cost of the parking facility, and in addition require even more space. Moreover, this kind of installation must be publicly accessible, which on the one hand can endanger the parked automobiles in the sense of being stolen or damaged, and on the other hand can endanger individuals, particularly women.

For these reasons, various proposals have been made in the past for the construction of mechanized, automatic parking garages, in which the vehicles are left by their owners in an entrance, and then are loaded onto a lift platform by a special apparatus, then are conveyed to the entry of one of a plurality of parking compartments with the help of a lift platform, and finally are deposited within the corresponding parking compartment. In this connection, a particularly simple construction involves a circular arrangement with outwardly lying parking compartments and a central lift apparatus.

Swiss Patent specification CH-A5-649 340 discloses an automatic parking garage having:

(a) a storage silo with a circular periphery, which storage silo encloses a cylindrical inner shaft and includes, on a plurality of stacked parking levels, a plurality of radially directed parking compartments open toward the inner shaft;

(b) a conveying apparatus located in the inner shaft for the transportation of vehicles between at least one entrance and the parking compartments, or between the parking compartments and at least one exit, the conveying apparatus including a plurality of vehicle-receiving transport surfaces which are moveable in a vertical direction and can be rotated together in a horizontal direction about a central axis, such that they can be positioned through vertical movement at the level of one of the parking levels or at the level of the at least one entrance, or the at least one exit, and then, through rotation about the central axis, can be brought adjacent one of the parking compartments in the corresponding parking level.

In this parking garage, a plurality of parking compartments or single parking spaces are arranged in different parking levels radially about a cylindrical shaft. In the shaft is provided an elevator apparatus with a rotatable lift platform which defines two rotatable spaces for receiving vehicles. By vertical movement and/or rotation of the platform about a central axis, all parking compartments can be reached by the rotatable spaces.

The two rotatable spaces are provided parallel with one another at opposite sides of the central axis, and have their longitudinal axes displaced away from one another, so that their longitudinal axes are substantially out of alignment with the radial direction. The parking compartments of each parking level are correspondingly angled to each other, so that their longitudinal axes can be brought into alignment with the longitudinal axes of the rotatable spaces. The parking compartments of each level are divided into two equal halves, such that each of the halves can be directed only to one of the rotatable spaces, due to the different angulation.

On the one hand, because of the special arrangement of the parking compartments, the construction of the parking garage is relatively expensive. On the other hand, the deposit of the vehicles is relatively slow, because only two rotatable spaces are available, and only one rotatable space is available for half of the parking compartments of one level. No further details are given with regard to the necessary transfer apparatus for moving the vehicles between the rotatable spaces and the parking compartments.

A further automatic parking garage is known from the publication DE-A 1-38 31 463. In this parking garage, the parking compartments are arranged radially. For the distribution of the vehicles there is likewise provided a combined lift and rotating apparatus, which however provides only a single transport space. The loading and unloading of the transport lift is assisted by an accessory car on which is placed the vehicle to be parked. Since the transport lift can only accept one vehicle, this type of parking garage cannot perform a rapid in and out parking cycle. The use of accessory cars, moreover, makes special apparatus necessary for introducing the car into all parking compartments, requiring a considerable technical expenditure.

Special transfer apparatus for the transportation of vehicles between lift and parking compartment are furthermore known from publications WO91/18162 and EP-A1-0 395 601. In the first of these two publications, a transfer apparatus is proposed which is mechanically very expensive, and especially susceptible to breakdown, this transfer apparatus requiring several levels which are displaceable with respect to each other and have comb-like ends which, upon depositing the vehicle in the parking compartment, inter-engage with corresponding comb-like configurations in the bottom of the compartment.

In the second of these two publications, a transfer apparatus is disclosed which travels sideways with respect to the vehicle and utilizes one of the forward wheels to pull the vehicle into the lift and to push the vehicle into a parking compartment. Because of the external position of the transfer apparatus, additional room is required. Moreover, this transfer apparatus grips only one side of the vehicle, which leads to an unbalanced loading of the chassis.

SUMMARY OF THE INVENTION

A feature of one aspect of the present invention is to provide an automatic parking garage which is of a simple and space-saving construction, which ensures safe operation, and which makes possible above all a rapid turnover of vehicles, i.e. a quick parking and removal procedure.

This feature is attained with a parking garage by the transport surfaces, the parking compartments and the at least one entrance and exit being positioned radially around a central axis.

According to an aspect of the invention, the individual parking compartments on the parking levels and the lift mechanism are positioned in a precise radial direction. In this manner, the storage silo is particularly simple to construct, because the parking compartments do not need to be angled with respect to each other in a special arrangement. In the lift itself, several transport surfaces, preferably four, are provided for the vehicles, because the radial arrangement provides more space. The individual parking compartments can be accessed by all transport surfaces in the same manner, since the construction has a high degree of symmetry, and all compartments are equivalent to each other. Finally, the connection between a transport surface and a parking compartment is particularly simple, because the facing edges are very closely spaced due to the radial configuration.

The transport surfaces can be moved in various ways: In accordance with a first preferred embodiment of the invention, the transport surfaces are provided on a common transport platform, and are displaced together vertically by a vertical movement, and are rotated together by rotation of the transport platform.

According to a second preferred embodiment, the transport surfaces are vertically displaceable independently of one another by means of individual lifts, wherein the individual lifts are provided on a common rotary table which rotates about the central axis.

A further preferred embodiment of the invention is characterised in that a pulling apparatus operating in a radial direction is provided on each of the transport surfaces, for pulling a vehicle out of the at least one entrance or out of a parking compartment onto the transport surface, and for pushing a vehicle from the transport surface into the at least one exit or into a parking compartment.

A pulling apparatus of this kind makes it possible to utilize a minimum of mechanically moveable parts, because on the one hand no pallets, containers or similar moveable platforms with the corresponding necessary rails need to be provided in a quantity corresponding to the number of parking compartments, and on the other hand it is not necessary to position the vehicles themselves on such transport devices. Instead, the pulling apparatus moves the vehicle being parked by using the vehicle's own wheels, and thus avoids an unnecessary technical expenditure.

In accordance with a further embodiment, it is particularly advantageous in this connection to provide, in the at least one entrance, guideways for the wheels of an entering vehicle, such that when being driven into the at least one entrance, the vehicle is forced to assume a radial direction such that it can be securely gripped by the pulling apparatus on one of the transport surfaces, when this transport surface is brought adjacent to the at least one entrance.

In this manner, it is possible to avoid errors during the entering procedure, which can come about because of the differing vehicle sizes or the competence of the driver. Instead, each vehicle is positioned identically with respect to the pulling apparatus, and can then be drawn onto the transport platform without any problems.

In accordance with a further preferred embodiment, it is particularly appropriate (a) if the pulling apparatus includes a sliding carriage which is moveable along a guiderail positioned in the radial direction; and (b) if the sliding carriage has, on the outwardly directed side, two grip arms which are directed outwardly and parallel, which are displaceable tangentially with respect to each other and which are provided with rollers, whereby when a vehicle is to be drawn onto the transport surface, the grip arms can be shoved between the front wheels under the forward part of the vehicle, and can grip the forward wheels of the vehicle from the inside position.

By this means is created a particularly compact and space-saving mechanism which is easily integrated into the transport surface and can cooperate with all types of vehicles without difficulties.

Further preferred embodiments are found in the appended claims.

BRIEF DESCRIPTION OF THE DRAWINGS

The invention will now be more fully described below, utilizing example embodiments along with the figures, in which.

PREFERRED EMBODIMENTS OF THE INVENTION

Figure 1:
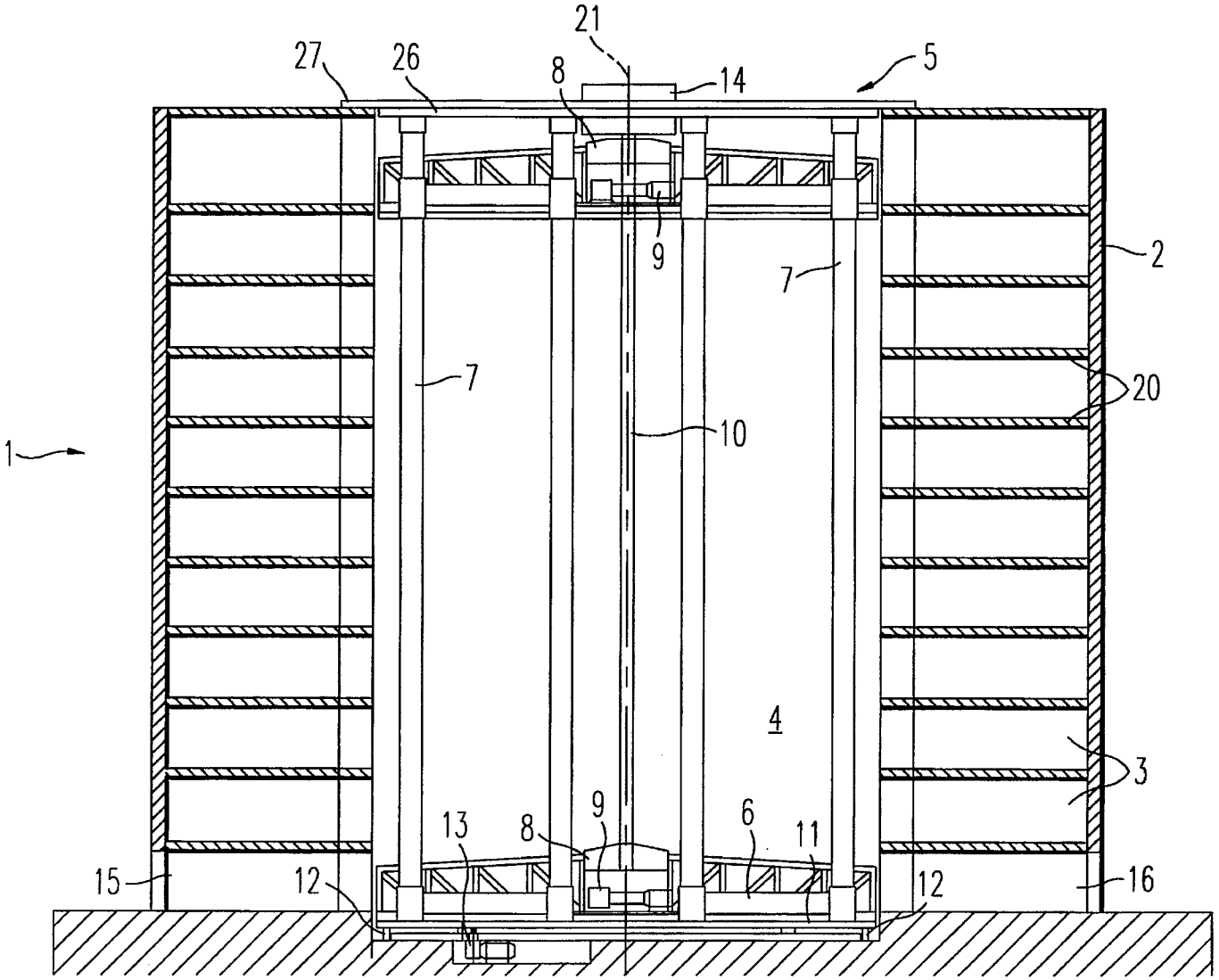
FIG. 1 is an axial section showing the internal construction of an automatic parking garage in accordance with a first preferred embodiment of the invention.
Figure 2:
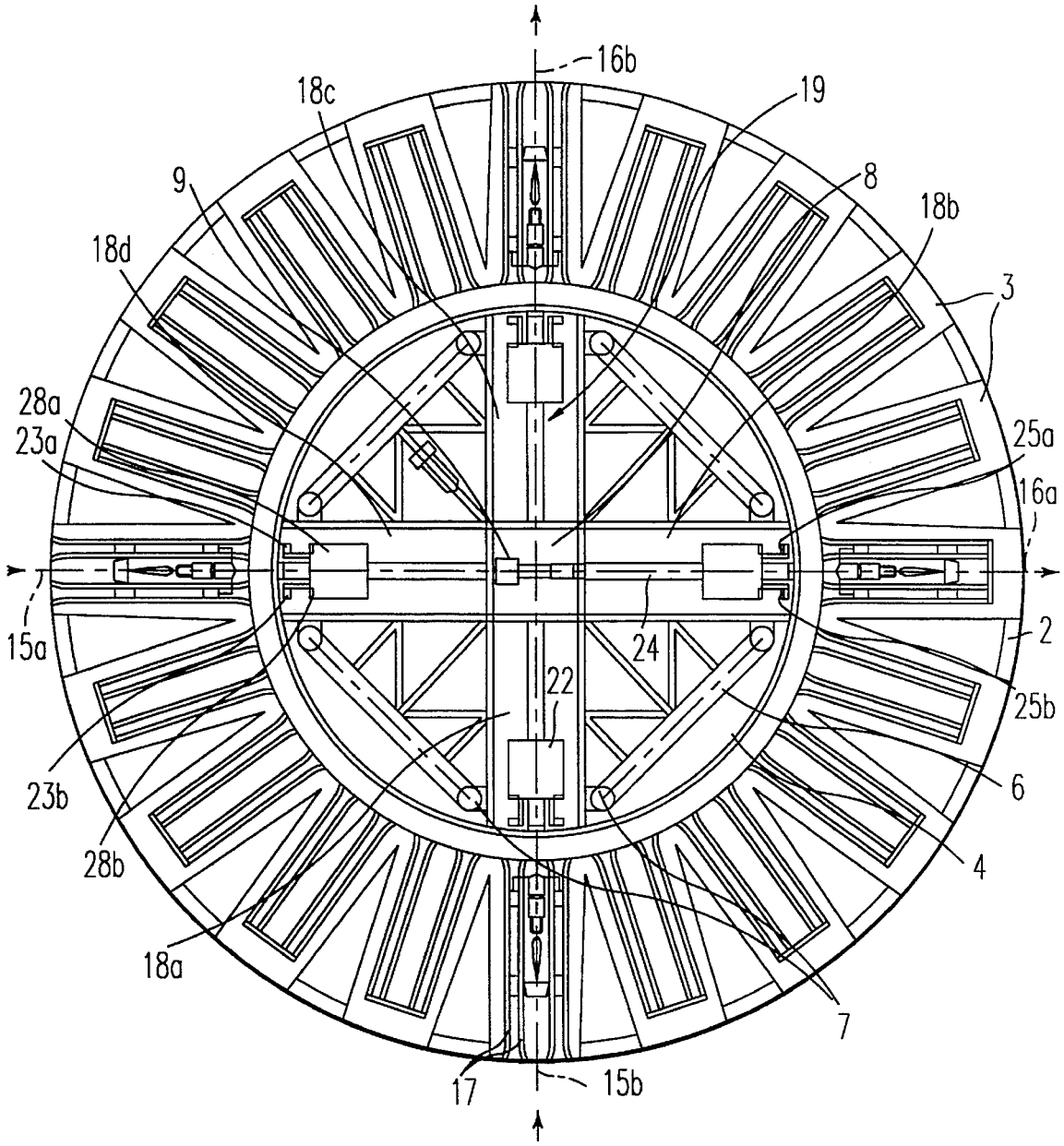
FIG. 2 is a plan view of the lower parking level showing the arrangement of parking compartments and the transport platform with the transport surfaces, in the parking garage according to FIG. 1.

FIG. 1 is an axial section showing the inner construction of an automatic parking garage in accordance with a first preferred embodiment of the invention. The corresponding plan view, at the position of the lowermost parking level, is illustrated in FIG. 2, such that like parts are identified with like numerals. The example embodiment is in the form of an above-ground building, i.e a structure placed on level ground and built upwardly with a plurality of floor levels. However, it is within the framework of the invention to contemplate constructing the parking garage (as in the example of FIG. 3) as an underground garage.

The parking garage 1 includes essentially a storage silo 2 with a circular outline, which silo includes a plurality of parking compartments 3 stacked above and beside each other on several parking levels 20, each parking compartment being adapted to receive a vehicle for the purpose of parking. The parking compartments 3 are elongated and are arranged with their longitudinal axis radially oriented with respect to a central axis 21 of the building. The parking compartments thus radially surround a cylindrical inner shaft 4, in which a conveying apparatus 5 is provided for transporting the vehicles from an entrance 15 to the parking compartments 3, and from the parking compartments 3 to an exit 16.

The conveying apparatus 5 includes a transport platform 6, which includes four transport surfaces 18*a* to 18*d* which extend outwardly from the central axis 21 and are rotationally spaced apart by 90°, upon which vehicles can be transported (in FIG. 1, the transport platform 6 is illustrated in two positions, specifically in the lower- most and the uppermost limit positions). The transport surfaces 18*a–d* are connected to each other by lattice-like bracing, and thus constitute a stable platform which is slidingly mounted on several guide columns 7 for movement in the vertical direction. In order to attain a high level of stability even when the transport platform 6 carries an unbalanced load of vehicles, the guide columns 7 are provided in pairs on both sides at the outer edge of each transport surface 18*a–d*.

In the examples shown in FIG. 1 and 2, the total of eight guide columns 7 (two each per transport surface 18*a–d*) each have their lower end secured to a rotary table 11, and their upper end secured beneath a bearing plate 26. The rotary table 11 is rotatably supported at the bottom of the inner shaft 4, utilizing rollers 12 running on tracks. The same construction applies to the upper bearing plate 26, which is rotatably supported in a central pivot bearing 14 provided on a roof 27 for the inner shaft 4. The rotary table 11 is driven by a rotary table drive 13 (e.g. electrical), of which the drive gear engages an overlying ring gear. The rotary table drive 13, as shown in FIG. 1, can be provided at a fixed location in a recess at the bottom of the inner shaft 4. In this case, the ring gear is secured to the underside of the rotary table 11. However, the drive can also be mounted directly to the rotary table 11, to allow for a possible sump, in which case the ring gear would be mounted to the bottom of the inner shaft 4.

The transport platform 6 with its transport surfaces 18*a–d* is thus vertically displaceable, and also rotatable about the central axis, so that each of the transport surfaces 18*a–d* can communicate with each of the parking compartments 3. Vertical movement along the guide columns 7 is preferably carried out using a lift unit 8 located in the middle between the transport surfaces 18*a–b* on the transport platform. The lift unit 8 includes an electrically driven cable winch 9 with a cable drum around which a suspension cable 10 can be wrapped. The other end of the suspension cable is secured to the transport platform 6 and, in the manner of a block and tackle, is entrained about a guide pulley located under the bearing plate 26.

In order to keep the drive load for the lift unit 9 as small as possible, it is advantageous to provide a counterweight for the transport platform 6, the counterweight being connected with the transport platform 6 through a cable which runs over a guide pulley, such that the counterweight descends as the transport platform 6 rises, and vice versa. If the guide columns 7 have hollow interiors, they could receive free running counterweights such that cables entrained over corresponding idler rollers at the upper end of the guide columns could be secured to the transport platform 6.

As can be seen in FIG. 2, each transport surface 18*a–d* has associated therewith a pulling apparatus 19 which draws the vehicle being transported out of one of the entrances 15*a,b* or a parking compartment 3, or pushes the vehicle from the transport surface into an exit 16*a,b* or into a parking compartment 3. The pushing or pulling operation takes place completely automatically, without the assistance of a driver.

Each pulling apparatus 19 includes a sliding carriage 22, which is mounted for movement along a guide rail 24 extending in the longitudinal direction of the transport surfaces 18*a–b*. The sliding carriage 22 has, on the side directed toward the parking compartments 3, the entrances 15*a,b* and the exits 16*a,b*, two tangentially displaceable gripping arms 23*a,b* which extend parallel to each other and which are provided with rollers 25*a,b* on their hook-shaped ends. In order to move a vehicle onto the transport surface, the gripping arms 23*a,b* are firstly moved toward each other perpendicularly to the longitudinal axis of the transport surfaces 18*a–d*, until they are close enough to each other that the sliding carriage 22 along with the gripping arms can be shoved between the front wheels of the vehicle to be moved. The sliding carriage 22, with the gripping arms 23*a,b* in the withdrawn position is pushed far enough under the vehicle that the gripping arms 23*a,b* with their hook-shaped ends can obtain a grip behind the front wheels of the vehicle. Next, the gripping arms 23*a,b* are moved apart so that the rollers 25*a,b* located at the inside ends lie against the treads of the front wheels. When the sliding carriage now moves in the direction of the central axis 21, the gripping arms 23*a,b* pull the vehicle by its front wheels out of the parking compartment or entrance onto the adjacent transport surface 18*a–d*. During the reverse process of expelling the vehicle, the sliding carriage 22 directly pushes the vehicle by its front wheels. In this case, in order to allow the wheels to turn freely, corresponding rollers 28*a,b* are provided on the outer side of the sliding carriage 22.

In order to allow vehicles, which have been parked in the entrances 15*a,b*, to be directly and reliably pulled by the pulling apparatus 19, a pair of guideways 17 are provided on the floor of at least the compartment-like entrances 15*a,b*, the guideways 17 assisting even an inexperienced driver to place his vehicle in the entrance so that it is lined up with the pulling direction. For security, such guideways 17 can also be provided in the individual parking compartments 3, as illustrated in FIG. 2, although in general this is not necessary.

For security reasons, it is possible to provide, in the entrances 15*a,b*, automatic sliding doors which isolate the entrances from the inner shaft 4 until the driver has left both his vehicle and the entrance compartment. Further, at the outer ends of each transport surface 18*a–d* there are provided hinged elements providing a kind of hinged bridge which, when a transport surface comes adjacent a parking compartment 3 for the removal or deposit of a vehicle, is swung outwardly in order to bridge across the space between the transport surface and the compartment floor.

Because of the cross-like arrangement of the individual entrances 15*a,b* and exits 16*a,b*, as well as the four transport surfaces 18*a–d* on the transport platform 6, skillful control of the parking procedure allows for vehicles to be moved in a single lift cycle, with two vehicles being parked and two being removed. In this manner, it is possible to achieve a high turnover of vehicles with minimal space requirements, such that only a small waiting period is required for the individual parking customers.

By virtue of the symmetrical and uniform arrangement of the parking compartments 3, it is possible to construct the storage silo using two kinds of prefabricated units, so that the cost and time of construction are reduced, and a modular construction process, with a corresponding expansion option, is possible.

Figure 3:
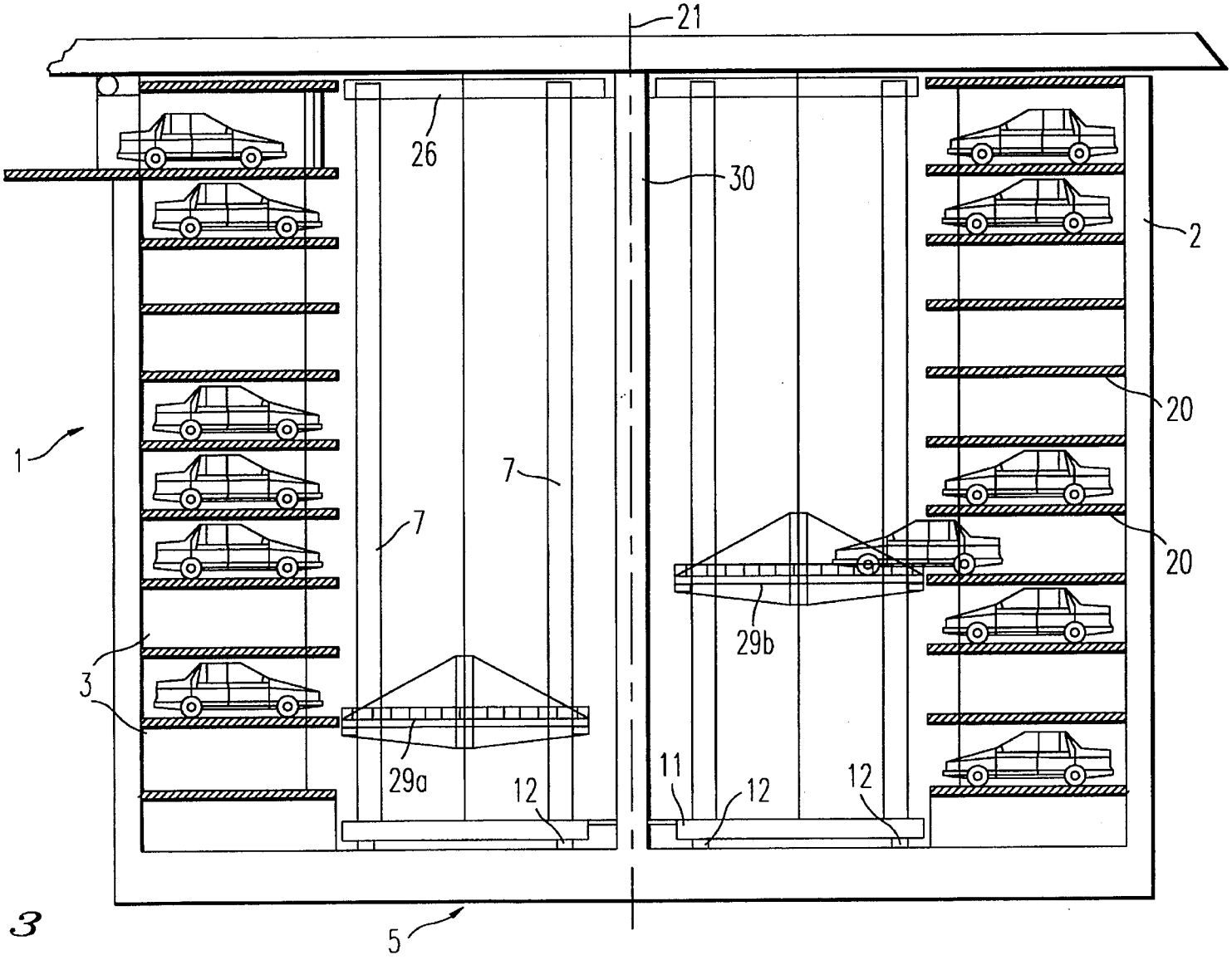
FIG. 3 is a sectional view similar to FIG. 1, showing an automatic parking garage in accordance with a second preferred embodiment of the invention.

Although in the first example embodiment described above all of the transport surfaces 18*a–d* are arranged on a common transport platform 6 and thus can only be moved together in the vertical and horizontal directions, the second preferred embodiment illustrated in axial section in FIG. 3 allows a more flexible process for parking and removal, by virtue of the fact that the transport surfaces are vertically moveable independently of one another utilizing individual lifts 29*a,b*. The individual lifts 29*a,b* are provided on a common rotary table 11 which rotates about a central axis 21, as has already been described in connection with FIG. 1. For purposes of reinforcement, a stable central column 30 can be additionally provided at the rotational axis 21.

Because of the individual lifts 29*a,b*, it is possible to park or remove vehicles from different parking levels 20 at the same time using a specific placement of the rotary cable, allowing a further increase in vehicle turnover. In this case, the individual lifts 29*a,b* are also guided in the vertical direction utilizing guide columns 7, such that the guide columns 7 are provided in pairs on both sides of the forward and rearward ends of the transport surfaces (FIG. 3). Also in this case it will be understood that the transport surfaces can be provided with corresponding pulling apparatuses, as have already been described above in connection with FIG. 2. It is pointed out that, in contrast to FIG. 1, the example illustrated in FIG. 3 is in the form of an underground garage.

Figure 4:
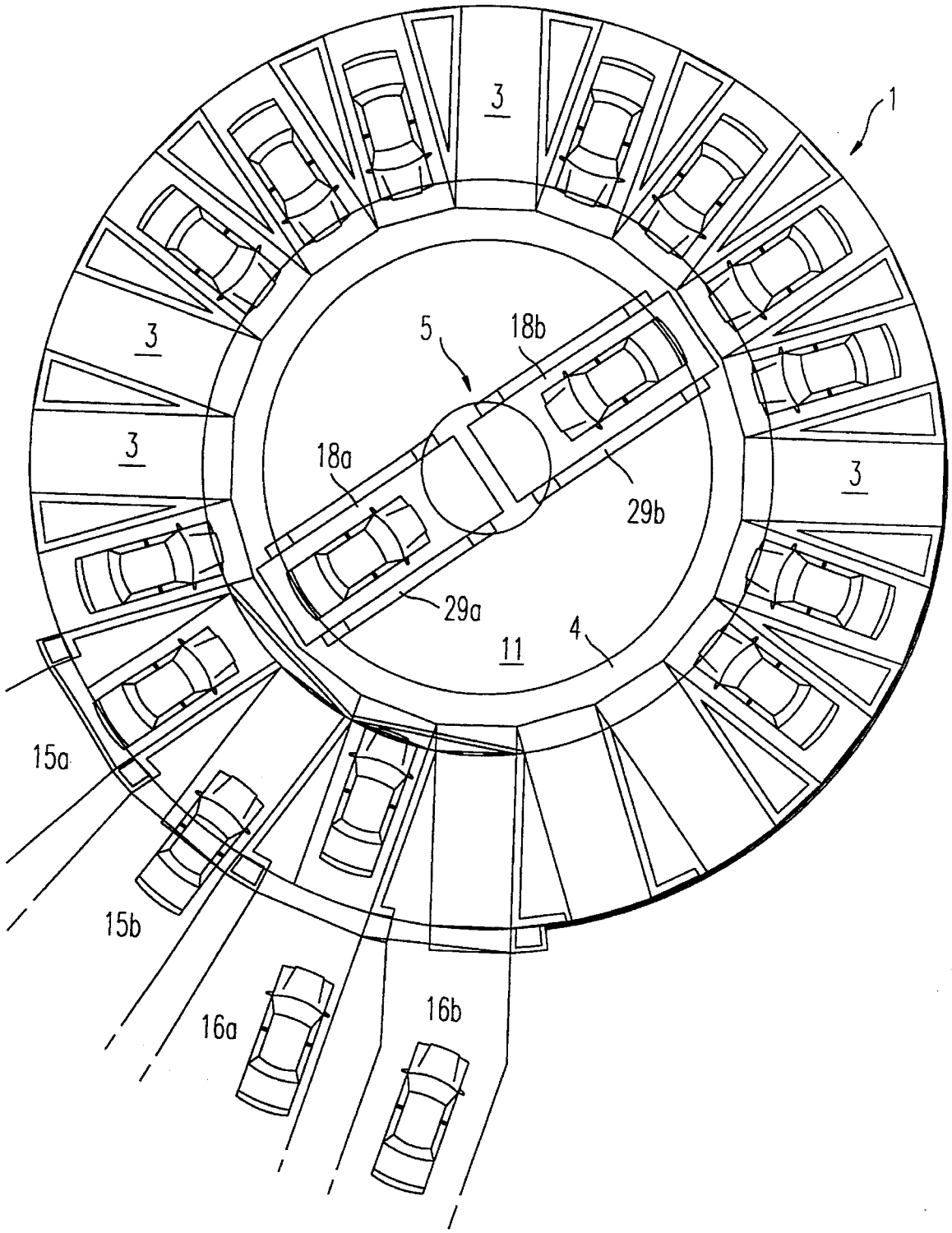
FIG. 4 is a plan view of the uppermost parking level, showing the arrangement of the parking compartments and the individual lifts in relation to the transport surfaces, in a parking garage according to FIG. 3 having two lift units.
Figure 5:
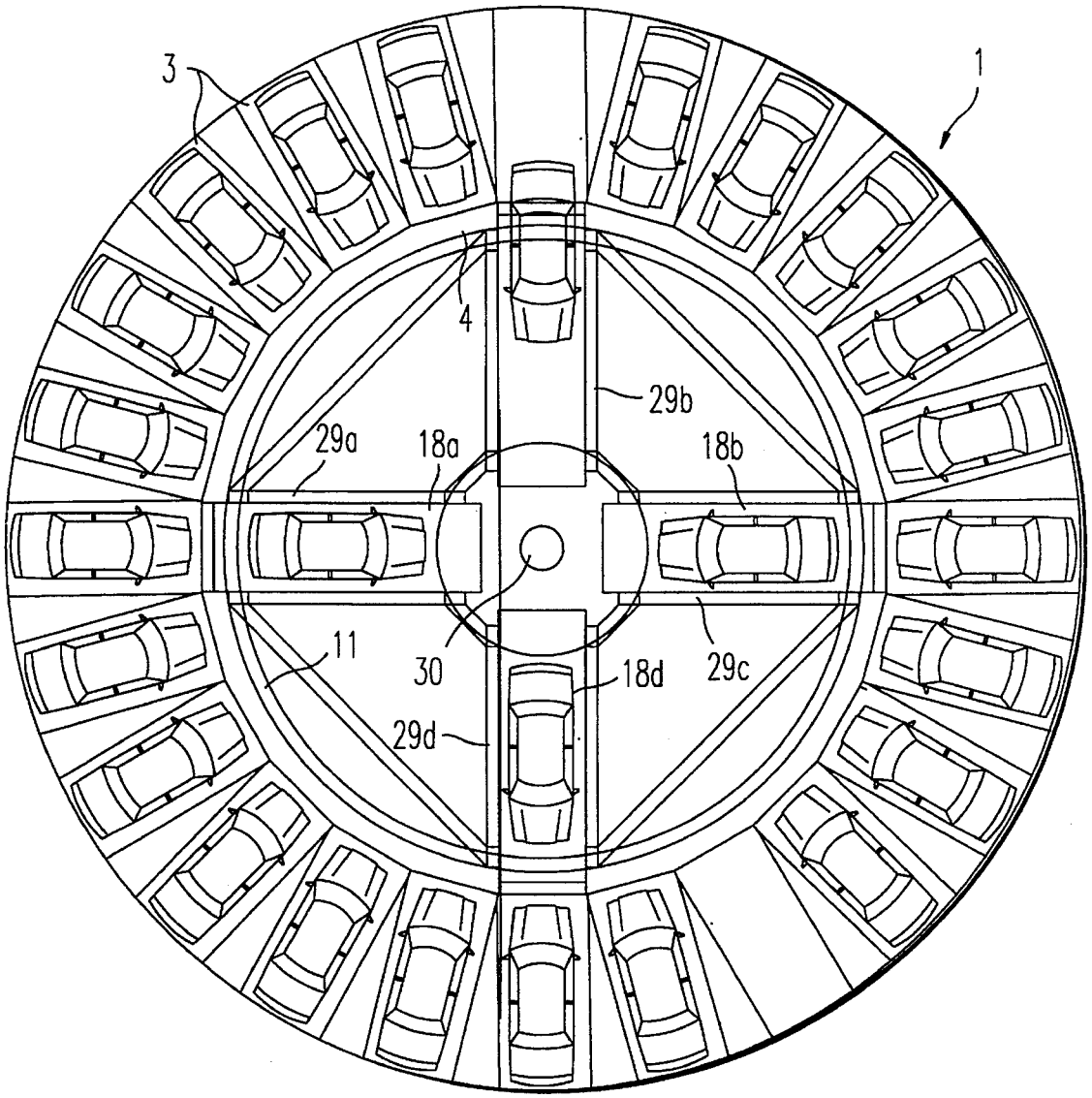
FIG. 5 is a plan view of a parking level showing the arrangement of parking compartments and the lift units with respect to the transport surfaces in a parking garage in accordance with FIG. 3, utilizing four lift units.
Figure 6:
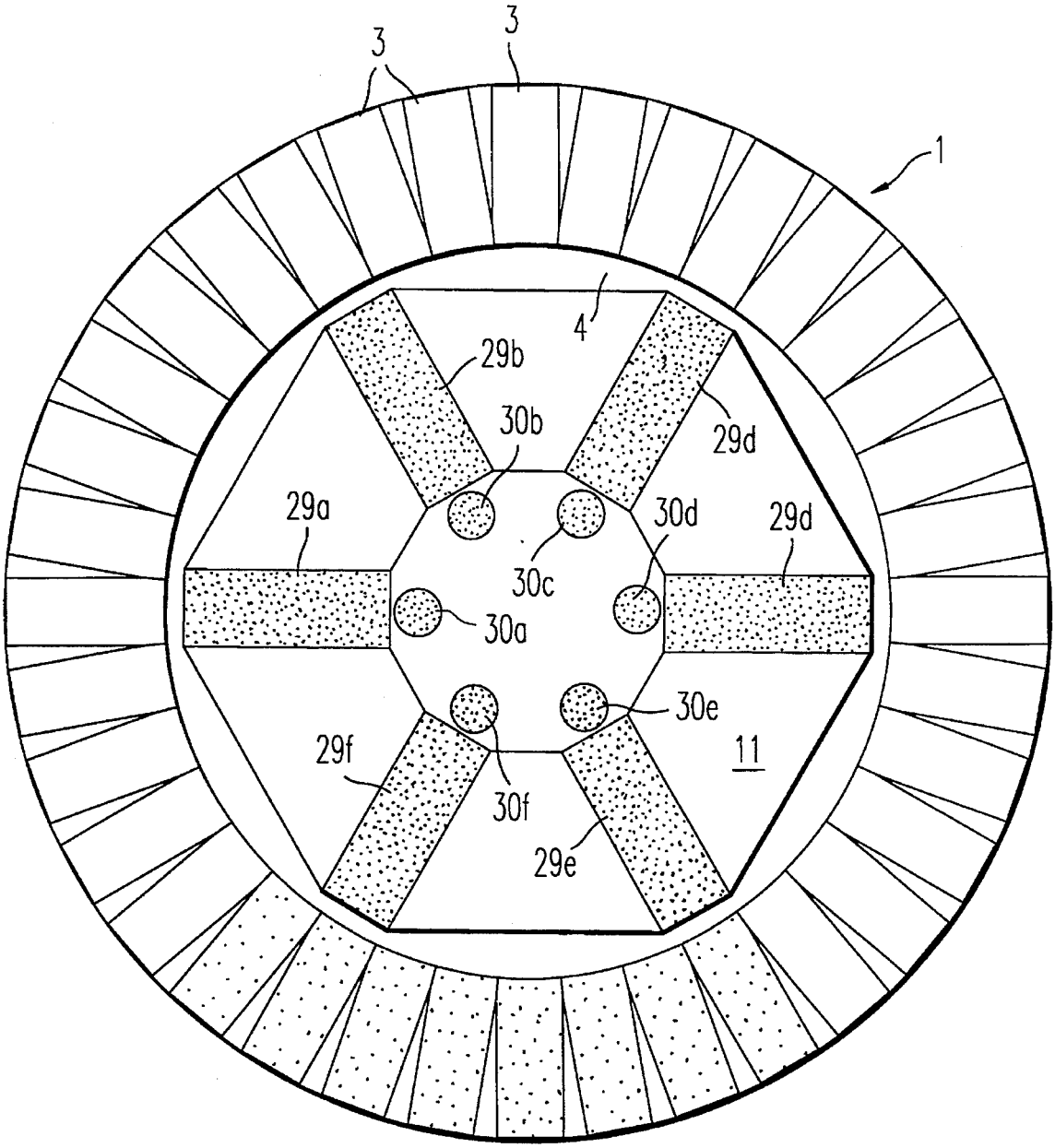
FIG. 6 is a plan view of a parking level showing the schematic arrangement of parking compartments and the lift units with respect to the transport surfaces in a parking garage according to FIG. 3 utilizing six lift units.

More or fewer individual lifts with the corresponding transport surfaces can be provided, depending upon the desired rate of vehicle turnover. In FIG. 4, which is a plan view of the uppermost parking level (with entrances and exits 15*a,b* and 16*a,b*, respectively) of an underground parking garage in accordance with FIG. 3, only two oppositely lying individual lifts 29*a,b*, with the corresponding transport surfaces 18*a,b*, are provided. In FIG. 5, in comparison with FIG. 2, four individual lifts 29*a–d*, with the corresponding transport surfaces 18*a–d*, are provided at 90° intervals, whereby in contrast to the example in FIG. 4 a considerable acceleration of the parking procedure is achieved. Finally, a further improvement can be attained with six individual lifts 29*a–f* at 60° intervals (FIG. 6), which can be stabilized with a plurality of inner columns 30*a–f*. A further increase in the number of lifts is conceivable, but would entail an increased space requirement in the inner shaft 4 of the parking garage 1.

Taken altogether, the invention makes possible an automatic parking garage which can be constructed in a simple, safe and space-saving manner, and can be operated at short turnover times.

NOMENCLATURE LIST

| | |
|---|---|
| 1. | Parking garage |
| 2. | storage silo |
| 3. | parking compartment |
| 4. | inner shaft |
| 5. | conveying apparatus |
| 6. | transport platform |
| 7. | guide column |
| 8. | lift unit |
| 9. | cable winch |
| 10. | suspension cable |
| 11. | rotary table |
| 12. | roller |
| 13. | rotary table drive |
| 14. | pivot bearing |
| 15;15a,b | entrance |
| 16;16a,b | exit |
| 17. | guideway |
| 18a–d | transport surface |
| 19. | pulling apparatus |
| 20. | parking level |
| 21. | central axis |
| 22. | sliding carriage |
| 23a,b | grip arm |
| 24. | guide rail |
| 25a,b | roller |
| 26. | bearing plate |

-continued

NOMENCLATURE LIST

| | |
|---|---|
| 27. | roof |
| 28a,b | roller |
| 29a–f | individual lift |
| 30. | inner column |
| 30a–f | inner column |

We claim:

1. A parking garage, which comprises:

a storage silo of circular plan, the storage silo enclosing a cylindrical inner shaft and, at several vertically spaced parking levels, a plurality of radially oriented parking compartments open toward the inner shaft;

a conveying apparatus provided in the inner shaft, said conveying apparatus transporting vehicles between at least one entrance and the parking compartments, and between the parking compartments and at least one exit, the conveying apparatus including a plurality of transport surfaces receiving vehicles, the transport surfaces being displaceable in the vertical direction and rotatable horizontally together about a central axis, such that the transport surfaces are brought, through vertical movement, to the level of one of the parking levels or of the at least one entrance, or of the at least one exit, and through rotation about the central axis are brought adjacent one of the parking compartments in the corresponding parking level wherein the transport surfaces, the parking compartments and the at least one entrance and exit are arranged radially about the central axis;

a rotary table wherein the transport surfaces are vertically displaceable independently of one another by individual lifts and the individual lifts are provided on said rotary table and are rotatable about the central axis;

a plurality of guide columns which guide the individual lifts in the vertical direction wherein the guide columns are provided in pairs at both sides of the forward and rearward ends of the transport surfaces wherein the guide columns are secured at lower ends thereof to the rotary table; and a plurality of rollers which rotatably support the rotary table on the bottom of the inner shaft;

a rotary drive rotating the rotary table; and a bearing plate rotatably mounted on to a roof of the inner shaft wherein the guide columns are secured at upper ends thereof to said bearing plate.

2. A parking garage according to claim 1, wherein:

(a) four of said transport surfaces are provided at 90° intervals; and (b) wherein said at least one exit comprises two entrances and wherein said at least one exit comprises two exits, said two entrances and two exits being provided at 90° intervals such that each entrance is directly opposite one of said exits.

3. A parking garage according to claim 1, wherein the parking compartments comprise prefabricated units which are stacked beside and above one another.

* * * * *